US006224050B1

(12) United States Patent
Wicki

(10) Patent No.: US 6,224,050 B1
(45) Date of Patent: May 1, 2001

(54) METHOD AND APPARATUS FOR FEEDING ASTRIDE FOLDED SIGNATURES TO A COLLECTION PATH

(75) Inventor: Herbert Wicki, Schuepfheim (CH)

(73) Assignee: Grapha-Holding AG, Hergiswil (CH)

( * ) Notice: Subject to any disclaimer, the term of this patent is extended or adjusted under 35 U.S.C. 154(b) by 0 days.

(21) Appl. No.: 09/336,667

(22) Filed: Jun. 18, 1999

(30) Foreign Application Priority Data

Jun. 22, 1998 (EP) ..... 98810569

(51) Int. Cl.[7] ..... B65H 1/22; B65H 3/64; B65H 5/12; B65H 5/34; B65H 5/04

(52) U.S. Cl. ..... 271/37; 271/112; 271/266; 271/268; 271/270; 271/276; 271/277

(58) Field of Search ..... 271/37, 112, 268, 271/270, 276, 278, 266, 82, 306, 277, 3.24, 165; 198/407.1, 644; 101/409

(56) References Cited

U.S. PATENT DOCUMENTS

| | | | | |
|---|---|---|---|---|
| 2,853,297 | | 9/1958 | Faeber . | |
| 4,018,161 | * | 4/1977 | Johne et al. | 101/231 X |
| 4,132,403 | * | 1/1979 | Weisbach et al. | 271/277 |
| 4,211,320 | * | 7/1980 | Yautz, Jr. et al. | 198/450 X |
| 4,386,771 | * | 6/1983 | Lakdawala | 271/82 X |
| 4,448,125 | * | 5/1984 | Kawaguchi et al. | 101/185 X |
| 4,629,175 | * | 12/1986 | Fischer et al. | 271/20 X |
| 5,141,221 | * | 8/1992 | Mack et al. | 271/270 |
| 5,168,809 | * | 12/1992 | Becker | 101/408 X |
| 5,350,167 | * | 9/1994 | Hansch | 271/82 X |
| 5,452,886 | * | 9/1995 | Cote et al. | 271/270 |
| 5,645,679 | | 7/1997 | Hansch . | |
| 5,833,229 | * | 11/1998 | Prim | 271/11 X |

FOREIGN PATENT DOCUMENTS

| | | |
|---|---|---|
| 0 675 062 | 10/1995 | (EP) . |
| 2027913 | 1/1971 | (GB) . |
| 1 583 527 | 1/1981 | (GB) . |
| 2 060 579 | 5/1981 | (GB) . |
| 2 275 917 | 9/1994 | (GB) . |

* cited by examiner

*Primary Examiner*—Christopher P. Ellis
*Assistant Examiner*—Kenneth W Bower
(74) *Attorney, Agent, or Firm*—Darby & Darby

(57) ABSTRACT

A method and an apparatus is disclosed for feeding astride signatures (3) to a collection path. The signatures (3) are removed from a magazine (4) with a conveyor drum (6) and transferred to an opening device (16). The transport speed of the signature lifted from the magazine (4) is first increased relative to a circumferential speed of the conveyor drum, in order to lengthen the time interval until the next signature (3) is removed. Thereafter, the transport speed of the signature (3) is decreased again either before or inside a region of the discharge location or in a capture region of the opening device, whereby the signature (3) is moved again in the opposite direction with respect to the circumference of the conveyor drum.

15 Claims, 6 Drawing Sheets

METHOD AND APPARATUS FOR FEEDING ASTRIDE FOLDED SIGNATURES TO A COLLECTION PATH

BACKGROUND OF THE INVENTION

The present invention relates to a method and an apparatus for feeding astride folded signatures to a collection path, wherein a signature is lifted partially from a stack and gripped on the fold by a rotating conveyor drum and transported on the circumferential path of the conveyor drum to a discharge location with the fold facing forwardly. The signature is subsequently moved to the collection path from a following opening device which grips the signature in a marginal region opposite the fold and moves in an approximately opposite direction.

An apparatus for processing signatures in this manner reaches its upper performance limit at a throughput of approximately 20,000 printed copies per hour, mainly as a result of the high feed speed, the short decollation time and the large acceleration forces etc. Additional technical measures are therefore required to improve reliability and/or performance.

One bottleneck exists along the path extending from the capture location between the signature magazine and the adjacent conveyor drum to the discharge location between the conveyor drum and the opening device. The processing time and operating performance and the reliability of the decollation process may be improved by moving the signatures faster along certain section of this path and/or by clearing these sections earlier, in order to gain time for the next decollating cycle.

SUMMARY OF THE INVENTION

It is an therefore an object of the present invention to implement an apparatus and a process according to the aforedescribed type in such a way that decollation of signatures is improved and the process reliability and/or performance is enhanced.

In general, according to one aspect of the invention, the transport speed of a signature taken from the stack is first increased relative to the circumferential speed of the conveyor drum and then decreased before a region or in a region of the discharge site or in the capture region of the opening device, respectively, so that the signature is again set back relative to the circumference of the conveyor drum.

Preferably, the transport speed of the signature in the discharge region is decreased with respect to these circumferential speed of the conveyor drum, so that the signature is slowed down before being transferred to the opening device.

Advantageously, the signature is slowed down, stopped or even moved in the reverse direction when reaching the discharge region or discharge location, respectively, so that the signature can be reliably transferred to the opening device.

According to another aspect of the invention, an apparatus for carrying out the method and feeding the collection path, respectively, includes a rotating conveyor drum which lifts a signature from a stack of an adjacent signature magazine with the fold of the signature facing forward. A suction device is associated with the conveyor drum for lifting the signature partially from the stack, and a gripping device is disposed on the circumference of the conveyor drum for gripping the lifted signature portion. An opening device is arranged after the conveyor drum. The opening device grips the marginal region opposite the fold of the signature at a discharge location arranged along the circular path of the gripping device and transports the signature in the opposite direction. The operating region of the opening device merges with the collection path.

According to one feature of the invention, the gripping device is connected to a lever which is located inside the conveyor drum and can be controllably tilted about an axis parallel to the rotation axis of the conveyor drum. The gripping device can also be rotated on the lever for displacing the signature on the conveyor drum in the direction of rotation along a path extending inwardly from the circumference of said conveyor drum approximately in the form of a spiral, thereby providing a very reliable operation.

According to another advantageous feature, the lever connected to the gripping device is attached to a shaft which is pivotally supported and forms the parallel axis. Advantageously, the free end of the lever is formed as a stationary portion of tongs of the gripping device, which has proven to be a very effective design.

According to yet another advantageous embodiment, a movable member cooperating with a stationary portion of the tongs for providing a gripping effect is attached to a gripper shaft which is supported on the lever parallel to the shaft. Accordingly, the movable member of the tongs can be moved to a closed position through the resilient force of a spring and to an open position with a control lever connected to a radial cam, which is known from conventional devices.

Preferably, for operating the gripping device, the gripper shaft may include a pinion which is drivingly connected to the control lever and a torsion spring through a toothed quadrant forming a cam.

Advantageously, the toothed quadrant, the torsion spring and the control lever may attached to a pivot axle which is supported concentrically with the shaft.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

The invention will be described hereinafter with reference to an embodiment taken in conjunction with the drawing to which reference is made with respect to all features not described in detail in the description. In the drawing is shown in.

DETAILED DESCRIPTION OF THE PRESENTLY PREFERRED EMBODIMENTS

FIGS. 1 to 4 show schematically a cross-section through a signature lay gauge 1 of a binder. The binder is not shown in its entirety in the Figures; only the collection path 2 is shown. The individually folded signatures 3 are placed on the collection path 2. The illustrated sections of a binder represent an apparatus for feeding astride folded signatures 3 to a collection path.

Figure 1:
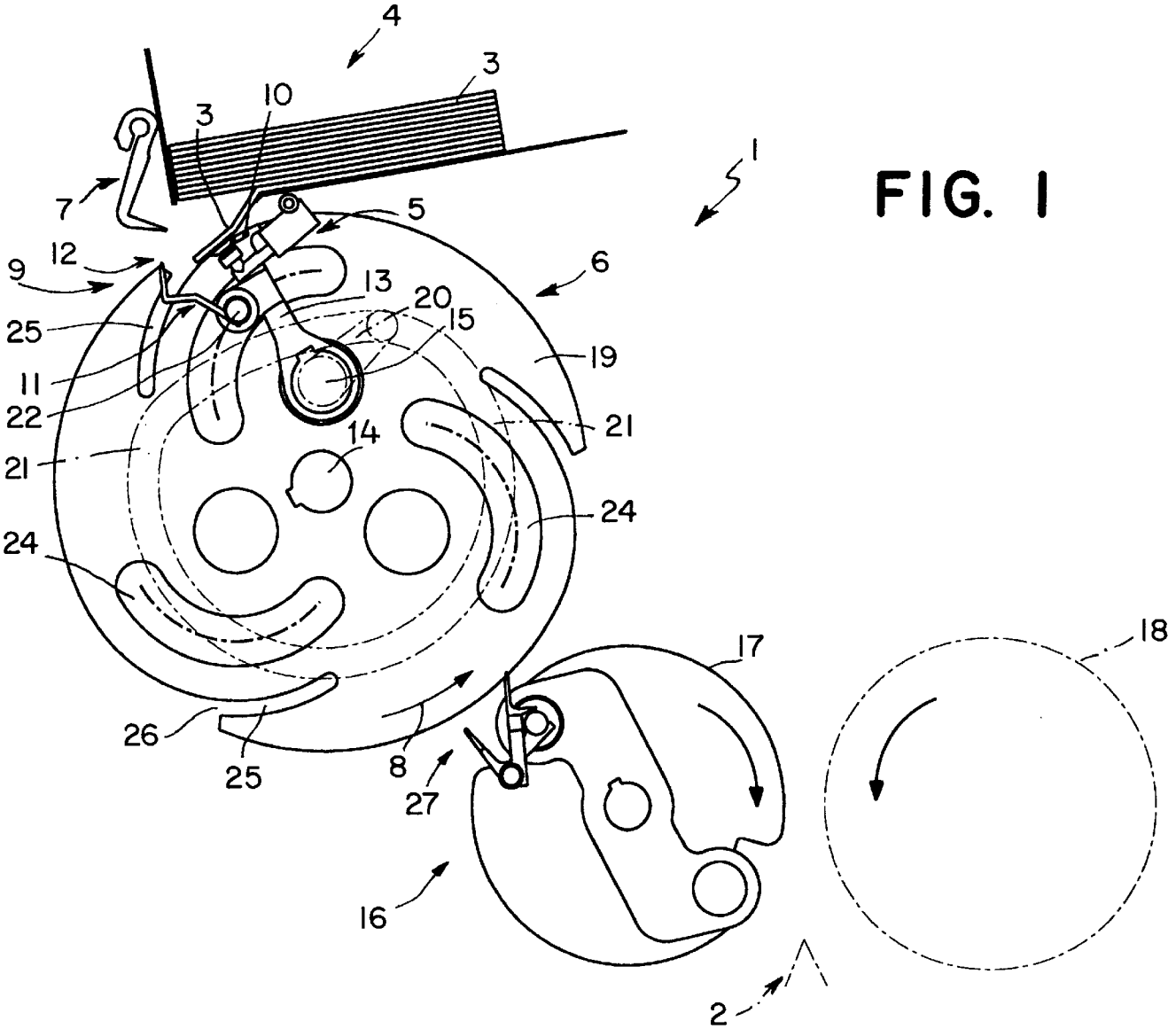
FIG. 1 is a schematic cross-section through an apparatus according to the invention for feeding a collection path, also referred to as signature lay gauge, at the time when a signature is decollated.

Referring now back to FIG. 1, the signature lay gauge 1 is shown in an initial position, wherein the lowermost signature 3 of a stack to residing in a raised magazine 4 is gripped at the fold by a driven suction device 5 and partially transported to the circumference of a conveyor drum 6.

For this purpose, a discharge opening located in the bottom of the magazine 4 is released by a pivotable retention device 7. The suction device 5 as well as the retention device 7 are stationary. The arrow 8 indicates the rotation direction of the conveyor drum 6 which includes three gripping devices 9 operating along the circumference of the drum 6, with one of the gripping devices 9 illustrated in the FIGS. 1 to 4. The gripping device 9 is formed of a stationary section 10 (also referred to as anvil) and a movable section 11 (gripper) of tongs 12. The tongs 12 are connected to a lever 13 which can be rotated about an axis parallel to the rotation axis 14 of the conveyor drum 6. The axis is implemented as a shaft 15 which is fastened to the lever 13 with keys. The tongs 12 is shown in FIG. 1 in the open position, and the signature section lifted from the stack is now contacting the end of the lever 13 which is formed as the stationary section of the tongs 12. In this way, the signatures section is held directly by the movable section 13 (gripper), which closes the tongs 12, on the anvil 10 and pulled from the magazine 4 by the rotation of the conveyor drum 6. An opening device 1 is arranged subsequent to the conveyor drum 6 which grips at the time of transfer a signature 3 at the free legs and places the signature 3 astride onto the collection path 2.

The opening device 16 includes two gripper drums 17, 18, which counter-rotate in the gripping region. Arrangements of this type are known and the art and will not be discussed further.

Figure 2:
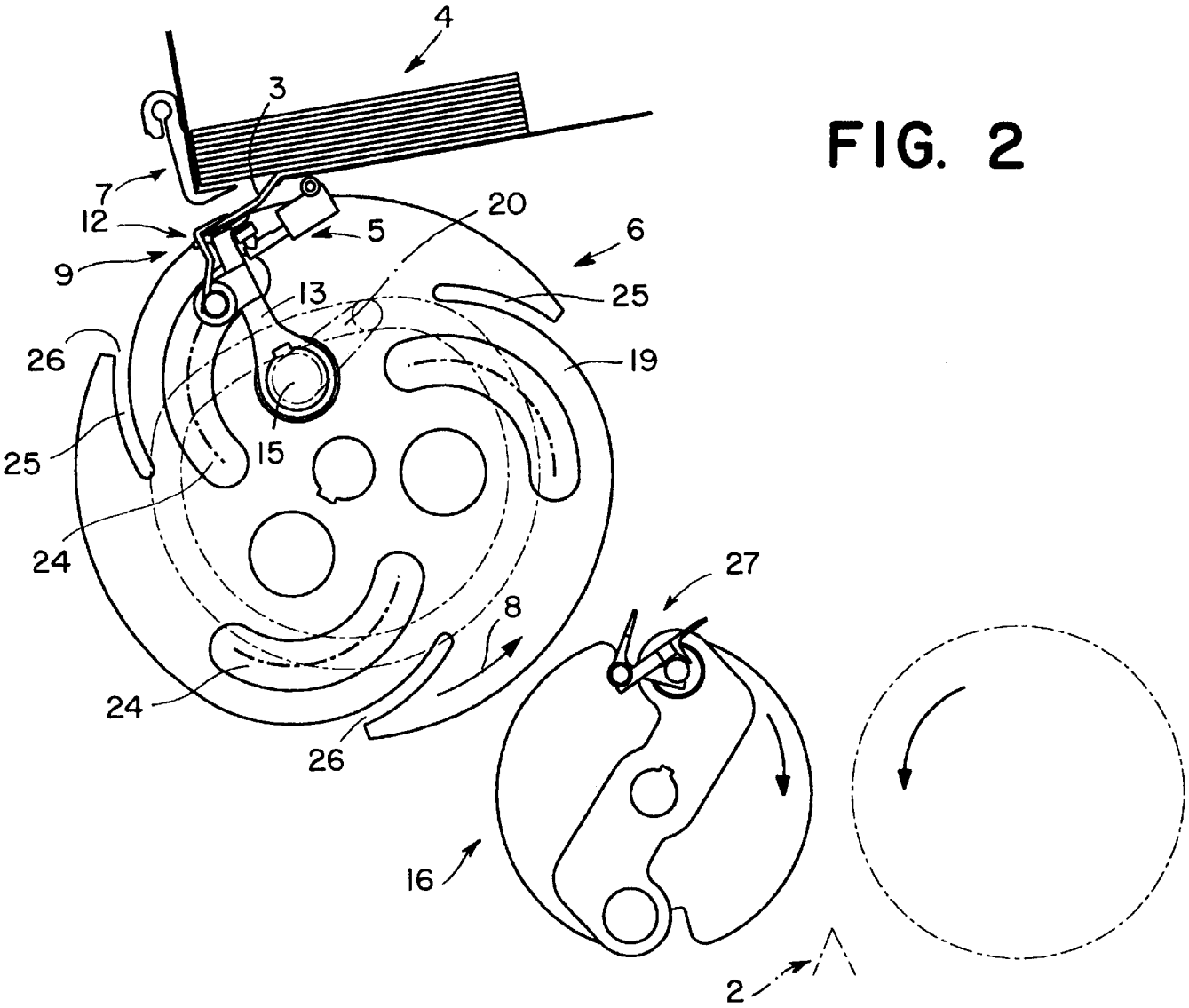
FIG. 2 is a schematic illustration of the device according to FIG. 1, when a partially lifted signature is gripped.

Referring now to FIG. 2, the tongs 12 are shown in the closed position, with the suction device 15 shown in a position before the signature 3 is lifted. The retention device 7 again maintains the opening of the magazine bottom in the closed position. The rotation of the tongs 12 is slowed or halted by a pivot motion of the lever 13 directed opposite to the conveyor drum 6, so that the signatures 3 is gripped gently at the surface. This measure is known in the art.

As soon as the signature 3 is clamped in the tongs 12, the lever 13 ceases to move in the reverse direction.

The lever 13 is then accelerated to a speed higher than the rotation speed of the conveyor drum 6 in order to increase the transfer velocity of a signature 3 from the magazine 4, and also to release the capture region above the conveyor drum 6 for the next transfer cycle at an earlier time and for a longer duration than before.

The shafts 15 of the levers 13 are supported in the driven disks 19 of the conveyor drum 6 which are arranged perpendicular to the rotation axis 14 and rotate with the shafts 15. A shield (not shown) is secured to one side of each disk 19, wherein the shield includes a closed radial cam 21 for controlling a lever 20 which is attached to the shaft 15 of the lever 13.

Figure 5:
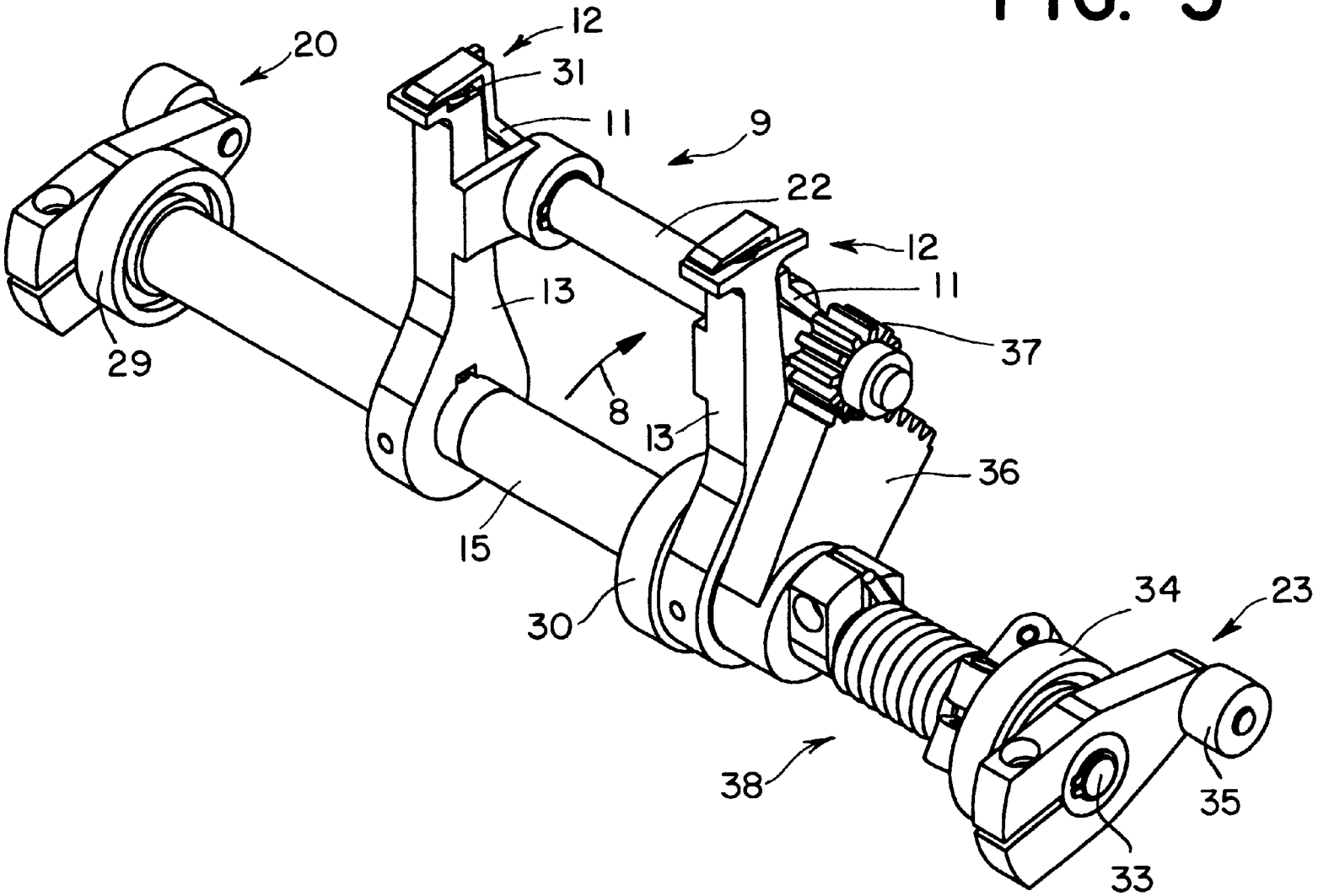
FIG. 5 is a perspective view of a gripping device of the device.

As shown in FIG. 5, the gripping device 9 includes two adjacent tongs 12, wherein the stationary section (anvil) 10 of the tongs 12 is formed by the free end of the lever 13 and the movable section (gripper) 11 is connected to do a gripper shaft 22 supported on the lever 13. The gripper shaft 22 is connected to a control lever 23 engaging with a radial cam (not shown), wherein the side of the radial cam is associated with the other disk 19 coupled to the conveyor drum 6.

In order to further decelerate and accelerate the gripping device 9 relative to the conveyor drum 6, respective recesses are provided in the disks 19 of the conveyor drum 6 which correspond to the pivoting radius of the lever 13. For example, one recess is associated with a respective shaft 15, another recess is associated with the gripper shaft 22, and still another recess is associated with the signature 3 that is clamped by the tongs 12. The recess 24 associated with the gripper shaft 22 is kidney-shaped, whereas the recess 25 associated with the signature 3 has an access opening 26 arranged on the circumference of the disk 19 and extending inwardly in form of a spiral with a uniform curvature corresponding to the pivoting radius of the lever 13. The recess associated with the shaft 15 is circular.

Figure 3:
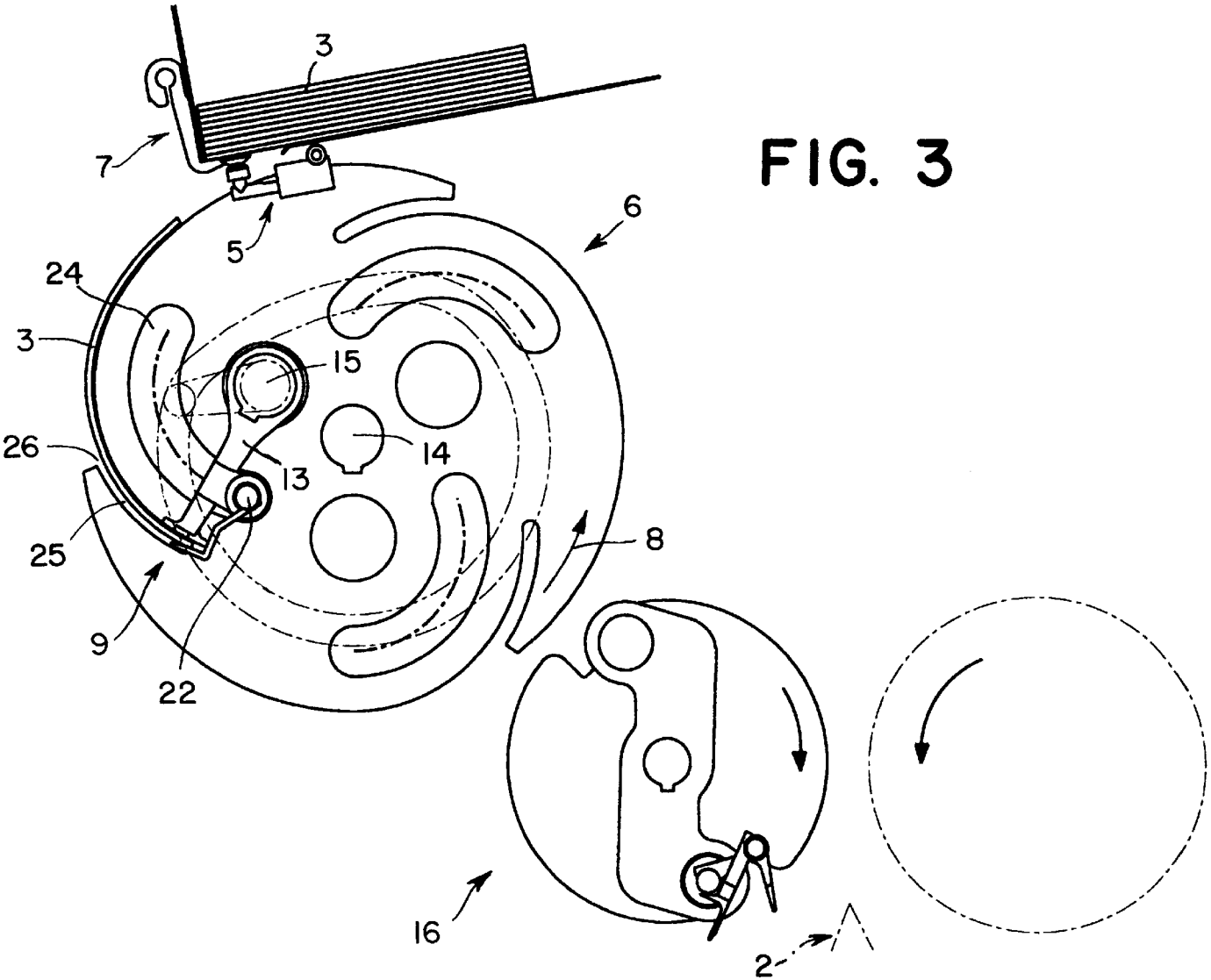
FIG. 3 is a schematic illustration of the device at a later time than in FIG. 2.

Referring now to FIG. 3, the signature 3 is partially inserted into the conveyor drum 6 by the gripping device 9 along the transport path of the conveyor drum 6, while the suction device 5 is in the initial position and the signature 3 contacts the circumference of the disks 19. At the illustrated time, the opening device 16 has changed according to the position shown in the FIGS. 1 to 3.

Figure 4:
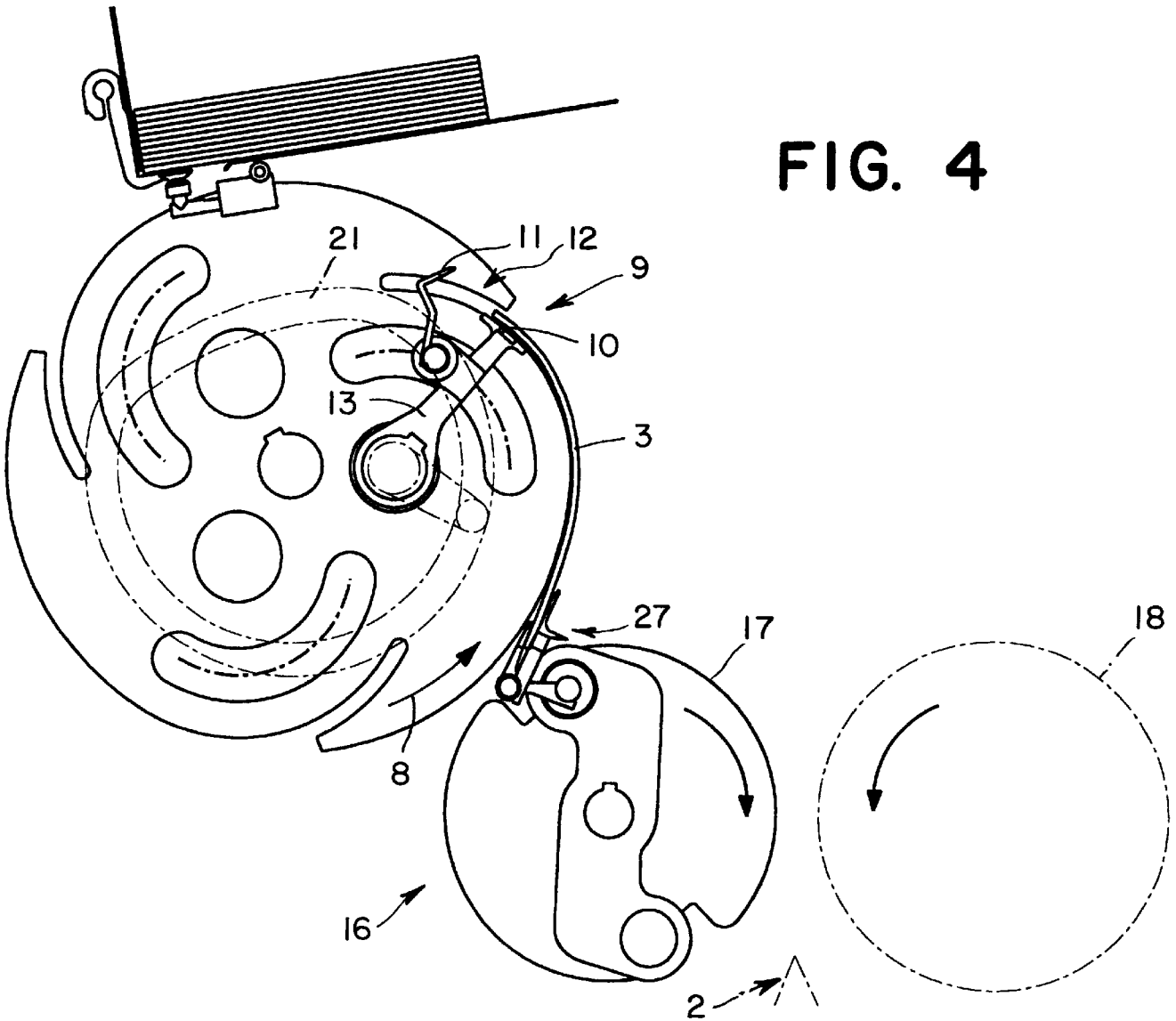
FIG. 4 is a schematic side view of the device when a signature is transferred to the opening device.

FIG. 4 shows the position in which the signature 3 is transferred when the clamp 27 from the conveyor drum 6 located on the gripper drum 17 of the opening device 16. The opening device 16 includes two counter-rotating gripper drums 17, 18 which together open the signature 3 after the signature 3 is transferred by the gripper drum 17, and place the signature 3 on the collection path 2. As illustrated, a circular section of the radial cam 21 encountered in this position keeps the lever 13 in place, so that the signature 3 is precisely received by the clamp 27 of the gripper drum 17. The tongs 12 of the gripping device 9 have already released the signature 3. The controlled clamp 27 is subsequently released and the signature 3 is held on the overfold or the leading edge, respectively, of the rear leg of the signature 3 by a so-called overfold gripper (not shown). The shorter leg then swings free and can be gripped by the gripper drum 18. The operation of the opening device is known in the art.

FIG. 5 shows the design of a shaft 15 of the conveyor drum 6 and the actuating elements connected thereto. As mentioned above, the shaft 15 is mounted to a disk 19 which is rotating with the conveyor drum 6, through a roller bearing 29, wherein this disk does not have recesses for the gripping counts 12 and the gripper shaft 22, since this disk is disposed outside the signature transport path. The lever 20 shown in FIGS. 1 to 4 is attached on the end of the shaft 15 associated with the roller bearing 29 and rotates with the conveyor drum 6 in the lateral stationary radial cam 21 (see FIGS. 1 to 4).

The disk 19 is arranged between the levers 13 which are connected to the shaft 15 through keys. The disk 19 rotates with the conveyor drum 6 and has recesses for the shaft 15 and the roller bearings 30, respectively, as well as the recesses 24, 25 for the pivotable gripper shaft 22 and the signatures 3 which are offset towards the inside.

FIG. 5 also illustrates the design of the gripper tongs 12 and the support of the gripper shaft 22, to which the movable section (gripper) 11 is connected. The movable section 11 is bent at a right angle. The nose-shaped end in conjunction with the free end of the lever 13 forms a clamping location, wherein the clamping location is located on the side of the lever and has a nonmetallic gripper support 31. The gripper shaft 22 is supported in bearing blocks 32 positioned adjacent to the levers 13.

The end of the shaft 15 that faces the lever 20 and to which end a lever is 13 attached, is formed with a concentric bearing bore (not shown). One end of a swivel axis 33 is supported in the bore, whereas the other end of the swivel axis 33 is supported in a further rotating disk 19 (not shown) which does not have recesses for the gripper shaft 22 and the signatures 3; for this purpose, roller bearings 34 are provided. The control lever 23, which engages a laterally offset stationary endless radial cam and actuates the swivel axis 33 during the rotation of the conveyor drum 6, is attached to the end of the shaft 33. Attached to the swivel axis 33 is a toothed quadrant 36 which is disposed adjacent to the lever 13 connected to the shaft 15. The toothed quadrant 36 engages with a pinion 37 attached to the end of the gripper shaft 22. The control lever 23 rotating in the radial cam operates the movable section (gripper) 11 of the tongs 12 which is formed on the end of the lever 13 and co-operates with the stationary section (anvil) 10, by opening the movable section 11 before the signature 3 is gripped from the stack, by closing the gripper 11 for gripping the signature, and by opening the gripper 11 for releasing the signatures 3 to the opening device 16. This process is known in the art.

An automatic thickness compensation device 38 is installed on the swivel axle 33 between the toothed quadrant 36 and the roller bearing 34 to prevent misalignment of the tongs 12 when signatures 3 of different thickness are processed. The thickness compensation device 38 ensures that the signatures 3 are reliably held by the tongs 12.

Figure 6:
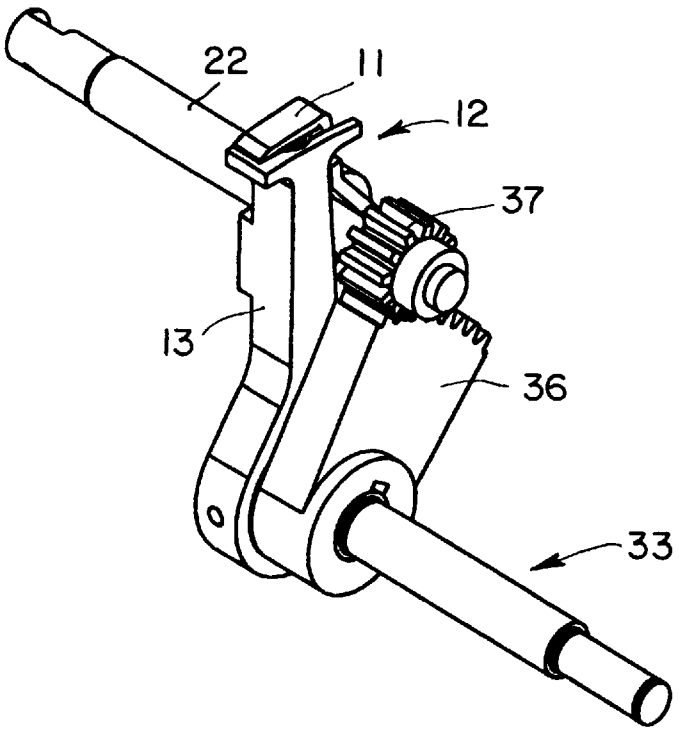
FIG. 6 shows means for operating the gripping device.

FIG. 6 shows the construction of the swivel axis 33 which is not visible in FIG. 5.

Figure 7:
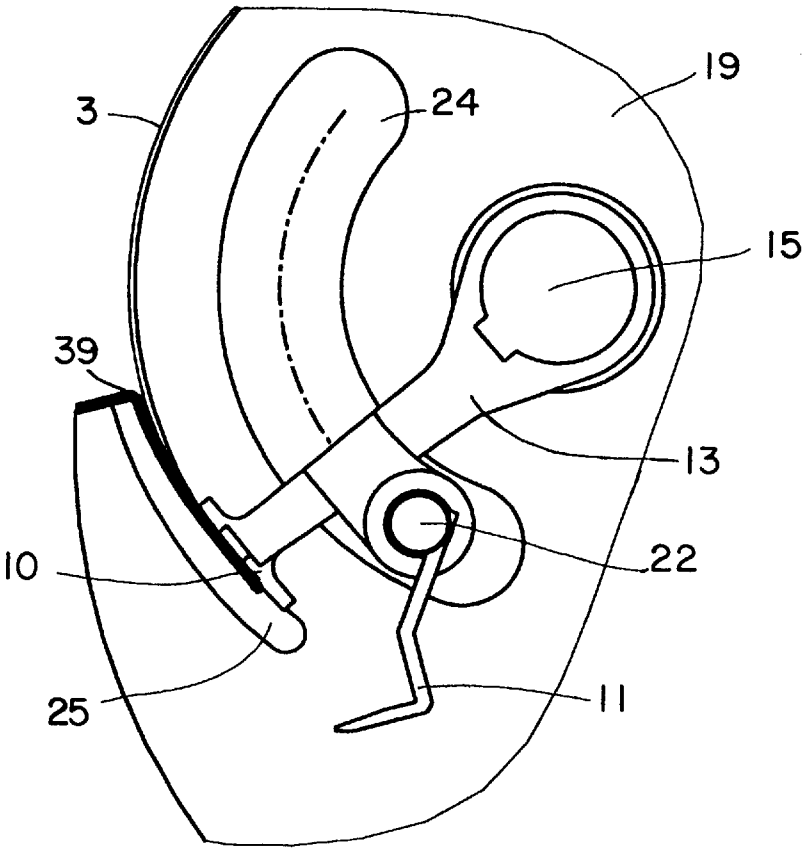
FIG. 7 is an enlarged partial schematic side view of individual components of the device.

FIG. 7 shows a feature for prematurely releasing a signature 3 from the tongs 12 in a position according to FIG. 3. For this purpose, a signature retaining element 39 in form of a leaf spring is attached to the access opening 26. The element 39 biases the inserted signature 3 against the inside wall of the recess 25 and holds the signature 3 on the inside wall even with the tongs 12 open.

Not only these alternative features, but largely the method, the operation and the implementation of the described invention make it possible to variably position a signature 3 on the conveyor drum without hitting the drum, so that the gripper drum 17 of the opening device 16 can grip the open edges of signatures 3 having different widths consistently at the same location, wherein the opening device 16 is driven synchronously with the collection path.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method for feeding astride signatures having a fold, to a collection path, comprising the steps of:

at least partially lifting one signature from a stack, gripping the signature on the fold with a rotating conveyor drum and transporting the signature with the fold facing forwardly to a discharge location located on the circumference of the conveyor drum;

moving the signature to the collection path with a subsequent opening device which holds the signature in a marginal region opposite the fold and transports the signature in an approximately opposite direction, and increasing a transport speed of the signature lifted from the stack relative to a circumferential speed of the conveyor drum and then decreasing the transport speed of the signature before or inside a region of the discharge location, in a capture region of the opening device respectively, whereby the signature is moved again in the opposite direction with respect to the circumference of the conveyor drum.

2. The method according to claim 1, further comprising the step of reducing the transport speed of the signature (3) in the discharge region with respect to the circumferential speed of the conveyor drum (6).

3. The method according to claim 2, further comprising the step of stopping the signature in the discharge region and moving the signature in the reverse direction.

4. The method according to claim 3, further comprising the step of positioning the signature on the circumference of the conveyor drum without hitting the conveyor drum.

5. The method according to claim 4, wherein the free edge of signatures having different widths is always located at the same position between the conveyor drum and the opening device, when the signatures are gripped by the opening device.

6. An apparatus for conveying folded signatures to a collection path, comprising:

a rotating conveyor drum for removing a signature from a stack of an adjacent signature magazine, with the fold of the signature facing forward;

a suction device associated with the conveyor drum for lifting the signature partially from the stack;

a gripping device disposed on the circumference of the conveyor drum for gripping the lifted signature portion; and an opening device following said conveyor drum, the opening device gripping the marginal region opposite the fold of the signature at a discharge location disposed along a circular path of the gripping device and transporting the signature in the opposite direction, with the operating region of the opening device terminating in a collection path, the gripping device is connected to a lever which is located inside the conveyor drum and can be controllably tilted about an axis parallel to the rotation axis of the conveyor drum, and, for displacing the signature on the conveyor drum in the direction of rotation, the gripping device can be rotated on the lever along an approximately spiraling path extending inwardly from the circumference of said conveyor drum.

7. The apparatus according to claim 6, wherein the lever connected to the gripping device is attached to a pivotally supported shaft forming the parallel axis.

8. The apparatus according to claim 7, wherein a lever which engages an continuous radial cam, is attached to the shaft.

9. The apparatus according to claim 8, wherein the free end of the lever is formed as a stationary portion of tongs associated to the gripping device.

10. The apparatus according to claim 9, wherein a movable member cooperating with the stationary portion of the tongs is attached to a gripper shaft which is supported on the lever and parallel to the shaft.

11. The apparatus according to claim 10, wherein the movable member (11) of the tongs (12) can be moved to an open or closed position with a control lever (23), which is connected to a radial cam.

12. The apparatus according to claim 11, wherein the gripper shaft comprises a pinion which is drivingly connected to the control lever through a toothed quadrant riding on the cam.

13. The apparatus according to the claim 12, wherein the toothed quadrant and the control lever are attached to a pivot axis which is supported concentrically with the shaft.

14. The apparatus according to claim 13, wherein the slotted recess associated with a signature comprises a signature holding element which presses the inserted signature against a wall of the recess.

15. The apparatus according to claim 14, wherein the controlled pivoting movement of a lever arm is adjustable in such a way that the open edge of signatures having different widths is provided at the same location between the conveyor drum and the opening device.

* * * * *